US008312694B2

(12) United States Patent
Hecht et al.

(10) Patent No.: US 8,312,694 B2
(45) **Date of Patent: *Nov. 20, 2012**

(54) REFRIGERATOR AND/OR FREEZER DOOR UNIT

(75) Inventors: Josef Hecht, Erlenmoos (DE); Georg Dorner, Steinhausen/Rottum (DE)

(73) Assignee: Liebherr-Hausgerate Ochsenhausen GmbH, Ochsenhausen (DE)

( * ) Notice: Subject to any disclaimer, the term of this patent is extended or adjusted under 35 U.S.C. 154(b) by 1170 days.

This patent is subject to a terminal disclaimer.

(21) Appl. No.: 11/795,941

(22) PCT Filed: Jan. 25, 2006

(86) PCT No.: PCT/EP2006/000637

§ 371 (c)(1),
(2), (4) Date: Apr. 3, 2008

(87) PCT Pub. No.: WO2006/079517

PCT Pub. Date: Aug. 3, 2006

(65) Prior Publication Data

US 2008/0190046 A1 Aug. 14, 2008

(30) Foreign Application Priority Data

Jan. 25, 2005 (DE) ..... 20 2005 001 177 U
Feb. 11, 2005 (DE) ..... 20 2005 002 231 U

(51) Int. Cl.
*F25D 23/02* (2006.01)

(52) U.S. Cl. ..... 52/784.1; 52/786.1; 49/475.1; 312/116

(58) Field of Classification Search ..... 52/782.1, 52/784.1, 784.13, 786.1, 204.591, 204.593, 52/204.597; 49/501, 504, 475.1; 62/131; 312/116

See application file for complete search history.

(56) References Cited

U.S. PATENT DOCUMENTS

| | | | | |
|---|---|---|---|---|
| 1,905,853 | A * | 4/1933 | Griffiths | 49/475.1 |
| 2,359,712 | A | 10/1944 | Howie, Jr. | |
| 3,965,638 | A * | 6/1976 | Newman | 49/501 |
| 4,087,139 | A * | 5/1978 | Heaney | 49/60 |
| 4,496,201 | A * | 1/1985 | Allgeyer | 49/501 |
| 4,753,043 | A | 6/1988 | Bockwinkel | |
| 4,831,780 | A * | 5/1989 | Bockwinkel | 49/504 |
| 4,897,975 | A * | 2/1990 | Artwick et al. | 52/208 |
| 4,948,206 | A * | 8/1990 | Fitzpatrick | 49/402 |
| 5,111,618 | A | 5/1992 | Kaspar et al. | |
| 5,363,611 | A | 11/1994 | Richardson et al. | |
| 5,894,706 | A | 4/1999 | Herbst | |
| 6,148,563 | A * | 11/2000 | Roche et al. | 49/501 |
| 6,655,760 | B1 * | 12/2003 | Sakata et al. | 312/116 |
| 6,722,142 | B1 | 4/2004 | Pagel | |
| 7,805,892 | B2 * | 10/2010 | Neumann et al. | 52/204.593 |
| 8,104,228 | B2 * | 1/2012 | Merla et al. | 49/475.1 |
| 2004/0163323 | A1 | 8/2004 | Herrmann et al. | |

FOREIGN PATENT DOCUMENTS

| | | |
|---|---|---|
| EP | 1316766 | 6/2003 |
| JP | 9-210540 | 8/1997 |
| JP | 2001-141352 | 5/2001 |

(Continued)

*Primary Examiner* — William Gilbert
*Assistant Examiner* — Matthew J Smith
(74) *Attorney, Agent, or Firm* — Dilworth & Barrese, LLP.

(57) ABSTRACT

A refrigerator unit and/or a freezer unit has a glass door which, in turn, has a door frame into which a glazing pane has been inserted. The door frame has a plastic jacket peripherally integrally shaped in one piece.

24 Claims, 5 Drawing Sheets

FOREIGN PATENT DOCUMENTS

| | | |
|---|---|---|
| JP | 2004-316945 | 11/2004 |
| KR | 1020000018013 | 4/2000 |
| KR | 2003-0057087 | 7/2003 |
| KR | 2003-0078470 | 10/2003 |
| SU | 411278 | 1/1974 |
| WO | 01/93727 | 12/2001 |

* cited by examiner

REFRIGERATOR AND/OR FREEZER DOOR UNIT

BACKGROUND OF THE INVENTION

The present invention relates to a refrigerator unit and/or a freezer unit comprising a glass door which has a door frame into which a glazing pane has been inserted. Refrigeration units in the sense of the present application can also be coolers in particular for the storage of wine.

Previous glass doors of refrigerator units are disadvantageous in a number of respects. To the extent their door frame comprises extruded aluminum sections which are miter cut and assembled, gaps are unavoidable at the joint positions due to tolerances. Additional applications such as locks, viewing windows and the like can only be introduced into the extruded sections with difficulty. In addition, the contour of the door frame is more or less predetermined by the frame sections and at best slightly adaptable by additional machining.

To the extent the frame of glass doors is made up of extruded plastic sections and/or injection molded parts by welding or plugging together, as a rule no high-quality visual effect can be achieved. Visible abutment points arise due to the welding. In addition, no uniform color or finish can be achieved due to the combination of different plastic parts.

SUMMARY OF THE INVENTION

It is therefore the underlying object of the present invention to provide an improved refrigerator unit and/or a freezer unit of the named kind which avoids disadvantages of the prior art and further develops it in an advantageous manner. A visually high-quality glass door with sufficient stability should in particular be provided.

This object is solved in accordance with the invention by a refrigerator unit and/or a freezer unit described herein. Preferred aspects of the invention also form the subject of the invention herein.

In accordance with the invention, the door frame surrounding the glazing pane is therefore not assembled from a plurality of pieces. It comprises a peripherally integral plastic jacket which is made in one piece and is free of seams at least on the visible side of the door. A previously unachieved, homogeneous visual appearance is thereby realized. Color deviations, visible gap formation or abutment points are eliminated. The outer envelope of the door comprises a uniformly made and aligned material over a full area. To nevertheless achieve the required stability, the plastic jacket can be foamed under or foamed out with a foam body in the periphery. The integrally one-piece plastic jacket can hereby be designed with substantially more variants and in almost any desired manner irrespective of the customary stability demands on the door frame.

The integrally one-piece plastic jacket in particular comprises an injection molded plastic section.

The outer side of the plastic jacket can have a coating, can in particular be lacquered, to achieve the desired visual appearance or also to achieve the surface properties in the desired manner.

The inner side of the plastic jacket is connected to the foam body in an areal manner, preferably fully areally. In particular when the plastic jacket has flanks inclined toward one another in cross-section, a considerable stiffening can be achieved by the foaming at the rear. The dimensional accuracy of the plastic jacket improves considerably by the foaming. At the same time, the foaming at the rear of the plastic jacket substantially improves the heat transfer coefficient, the so-called "K-value" of the section. Furthermore, a considerable reduction in condensate formation at the frame and at the transition to the glazing pane is achieved by the foam body. The door frame can also be kept largely free of condensate without a heating.

Alternatively or additionally, a peripheral frame stiffening portion can also be inserted into the plastic jacket and comprises a plurality of sectional pieces connected to one another. In accordance with an advantageous embodiment of the invention, the sectional pieces can be connected to the plastic jacket at the rear side thereof. In particular extruded plastic sections or extruded aluminum sections can be used which are placed onto the rear side of the plastic jacket and are advantageously adhesively bonded thereto.

To increase the stiffness achieved by the sectional pieces even further, the sectional pieces are advantageously connected to one another, in particular adhesively bonded to one another and/or jammed together so that they form a rigid peripheral reinforcement frame. They can also be latched to one another. Shear stresses can in particular also be intercepted particularly easily thereby.

The plastic jacket can be given different contours at its front side. In accordance with an advantageous embodiment of the invention, the plastic jacket has a front side shaped is a bulbous manner over the width and/or height of the door. Apart from a dynamic visual appearance, the door is hereby given an increased stiffness per se. In this connection, the curvature is not limited to a curvature in cross-section such as would be available with extruded sections. It is rather the case that the upper and lower transverse limbs are curved at their front side in the longitudinal direction of the transverse limbs, i.e. the total front side of the plastic jacket is slightly curved around a substantially vertical axis of curvature, whereby the plastic jacket is raised plastically from the planar glazing pane.

To achieve a precise visual appearance with sharp lines at the transition to the glazing plane, too, the plastic jacket can have a glazing pane portion which rises practically free of gaps on the glazing pane. The glazing pane portion of the plastic jacket can advantageously be formed in angular shape. A marginal web of the plastic jacket bounding the glazing pane portion can be kinked at a right angle or an acute angle with respect to the adjacent limb of the plastic jacket at the front side. A sharp, precise visual appearance is achieved here with respect to a rounded glazing pane portion.

Alternatively to a plastic jacket rim rising directly on the glazing pane, an integrally peripheral cover frame can also be inserted into the glazing plane portion of the plastic jacket. The cover frame can peripherally contact the rim of the plastic jacket bounding the glazing pane section; it can in particular be placed onto the said rim, which preferably extends substantially parallel to the glazing pane plane, with a peripheral groove so that the plastic jacket rim is engaged around by the cover frame at both sides. The cover frame is here preferably made in one piece with a slight excess size with respect to the glazing pane portion. It can nevertheless be inserted into the glazing pane portion thanks to elastic deformation. The cover frame is advantageously made gap free at the front side and also terminates largely gap-free toward the glazing pane, whereby contamination lines are avoided and a perfect visual appearance is also ensured over the long term.

If the plastic jacket has the previously described convexity transversely over the total door width, the named cover frame can have a varying depth to compensate the curvature of the front side of the door frame with respect to the planar glazing pane.

It is, however, understood that such an angular glazing pane portion does not necessarily have to be provided. In accordance with an alternative embodiment of the invention, a rounded glazing pane portion can also be introduced into the plastic jacket. This can in particular be done in that a rim web starting with a rounding from the front side of the plastic jacket is provided at the plastic jacket toward the glazing pane portion. Such an angled rim web effects a stiffening of the plastic jacket per se which gives the door a higher strength.

To permit a tolerance compensation between the glazing pane and the plastic jacket, an elastic seal can be interposed. This can generally be provided at the front side of the glazing pane, in particular when the previously described angled rim web is used. To achieve a precise visual appearance from the outside which is not disrupted by the occasionally unsightly rubber bead of the seal, the tolerance compensation is, however, transferred to the inner side. The front side of the glazing pane can directly contact the rim of the plastic jacket bounding the glazing pane portion or the previously described cover frame inserted therein. The elastic seal for the tolerance compensation is provided on the rear side.

The glazing pane can be attached to the door frame in different manners. In a further development of the invention, a glazing pane holder is provided for the glazing pane and it can be fastened to the frame reinforcement. If the previously described foam filler is provided, the glazing pane holder can be foamed into the foam body. The glazing pane holder can moreover also be directly connected to the plastic jacket itself.

The glazing pane holder advantageously has support limbs which project inwardly from the door frame and on which the flat side of the glazing pane lies. A suitable connection is expediently provided between the support limb and the glazing pane. The glazing pane can in particular be adhesively bonded onto the support limb. The door obtains its final stiffness thanks to the adhesive bonding of the glass to these parts.

To achieve good heat insulation, the glazing pane is a multiple glazing in a further development of the invention in which the glass panes are arranged spaced apart from one another. In accordance with an embodiment of the invention, three glass panes can be provided which are connected to one another by peripheral spacers at the rim side.

In a further development of the invention, an elastic lip seal which engages around the glazing pane and whose elastic lip compensates the thickness variation of the glazing pane is provided between the plastic jacket and the glazing pane and/or between the glazing pane holder and the glazing pane. This prevents moisture from entering, on the one hand. On the other hand, a clean termination is provided.

The elastic seal can have sections of different hardness and/or flexibility in this connection. A soft sealing lip can in particular be shaped on a harder securing section. For this purpose, the seal can be injection molded from different plastics in a two-component process. It is equally possible to mold on a softer sealing lip by co-extrusion. The seal can advantageously not only seal the glazing pane, but simultaneously take over a support function for the glazing pane.

To illuminate the door, a lighting device which directs light into the glazing pane can be provided at the door frame. For this purpose, light-emitting diodes or fluorescent lamps can be provided in the transition region between the door frame and the glazing pane. Optionally, a separate illumination of the unit interior can hereby be dispensed with. Further additional applications such as a frame heating can be provided inside the plastic jacket.

If the door should be extended toward the unit carcass above and/or below its seal in order, for example, to cover the unit or to project over it, additional parts, in particular door extensions, can be attached to the door frame which can then optionally also accept additional components such as a lock or thermometer.

BRIEF DESCRIPTION OF THE DRAWINGS

The invention will be explained in more detail in the following with reference to preferred embodiments and to associated drawings. There are shown in the drawings.

DESCRIPTION OF THE PREFERRED EMBODIMENTS

Figure 1:
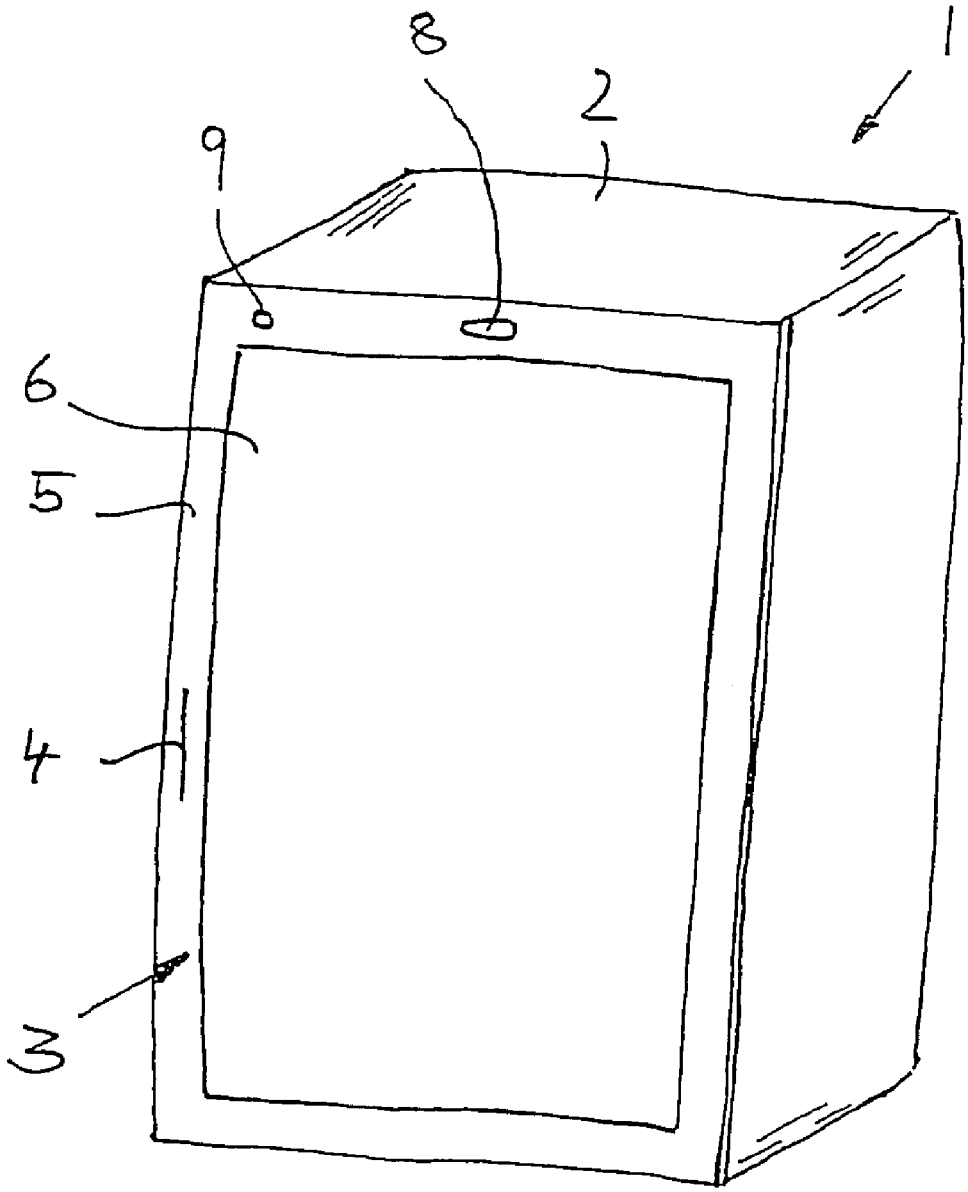
FIG. 1: a perspective view of a refrigerator unit with a glass door in accordance with a preferred embodiment of the invention in a schematic representation.

The refrigerator unit 1 shown in FIG. 1 has a substantially cubic unit carcass 2 which is itself made open at the front side and can be closed by a door 3. The door 3 is supported in a manner known per se pivotable at the unit carcass 2 around a vertical door pivot axis so that it can be pivoted open and closed around the pivot axis disposed at the right in FIG. 1 with the aid of a door handle 4.

Figure 2:
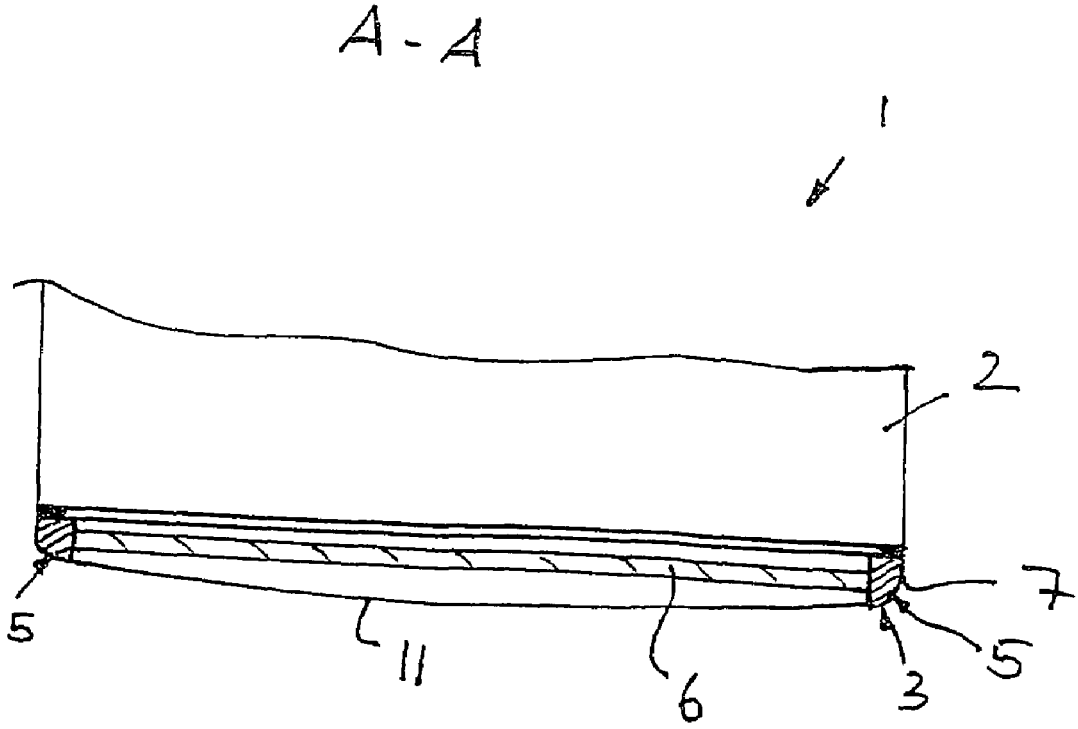
FIG. 2: a sectional view of the glass door of the refrigerator unit of FIG. 1 along the line A-A in FIG. 1.

As FIG. 2 shows in more detail, the door 3 is made as a glass door which has a door frame 5 into which a glazing pane 6 is inserted. With such glass doors, the door frame is made very narrow as a rule. The glazing pane 6 as a rule takes up more than ⅔ of the width or the height of the door.

The door frame 5 comprises a peripherally one-piece plastic jacket 7 which is made from one piece, is in particular injection molded from a suitable plastic. The plastic jacket 7 hereby advantageously has no seam positions or abutment positions, at least on its visible front side which FIG. 2 shows, as is the case with conventional metal glass doors which are assembled from a plurality of door frame pieces. The plastic jacket can optionally be lacquered to further improve the surface or to achieve the desired silky, metallic visual appearance.

Stamped-out portions for a thermometer 8 and a lock 9 are introduced into the plastic jacket 7 in the region of the upper transverse piece of the door frame 5.

Optionally, covers at the front face can be set onto the plastic jacket to cover the metal edges and the support and to improve the visual appearance.

To seal the door 3 with respect to the unit carcass 2, a seal 14 is seated running around the glazing pane 6 on the door frame 5 at the rear and is pressed toward the unit carcass 2 on the closing of the door.

If the door 3 should be extended above and/or below the seal 14 in order to cover or project over the unit, for example, additional parts can be installed which can then optionally receive the additional components such as the lock 9 or the thermometer 8.

As FIG. 2 shows, the plastic jacket 7 is made slightly bulbously at its front side over the whole width of the door. The upper and lower transverse limbs 11 are slightly curved over their length, i.e. from the left to the right in accordance with FIG. 1. The difference toward the planar glass pane 6 which results from this is compensated either by a cover frame inserted into the glazing pane portion or by rim webs of the plastic jacket angled toward the front side, as will be explained in more detail.

Figure 3:
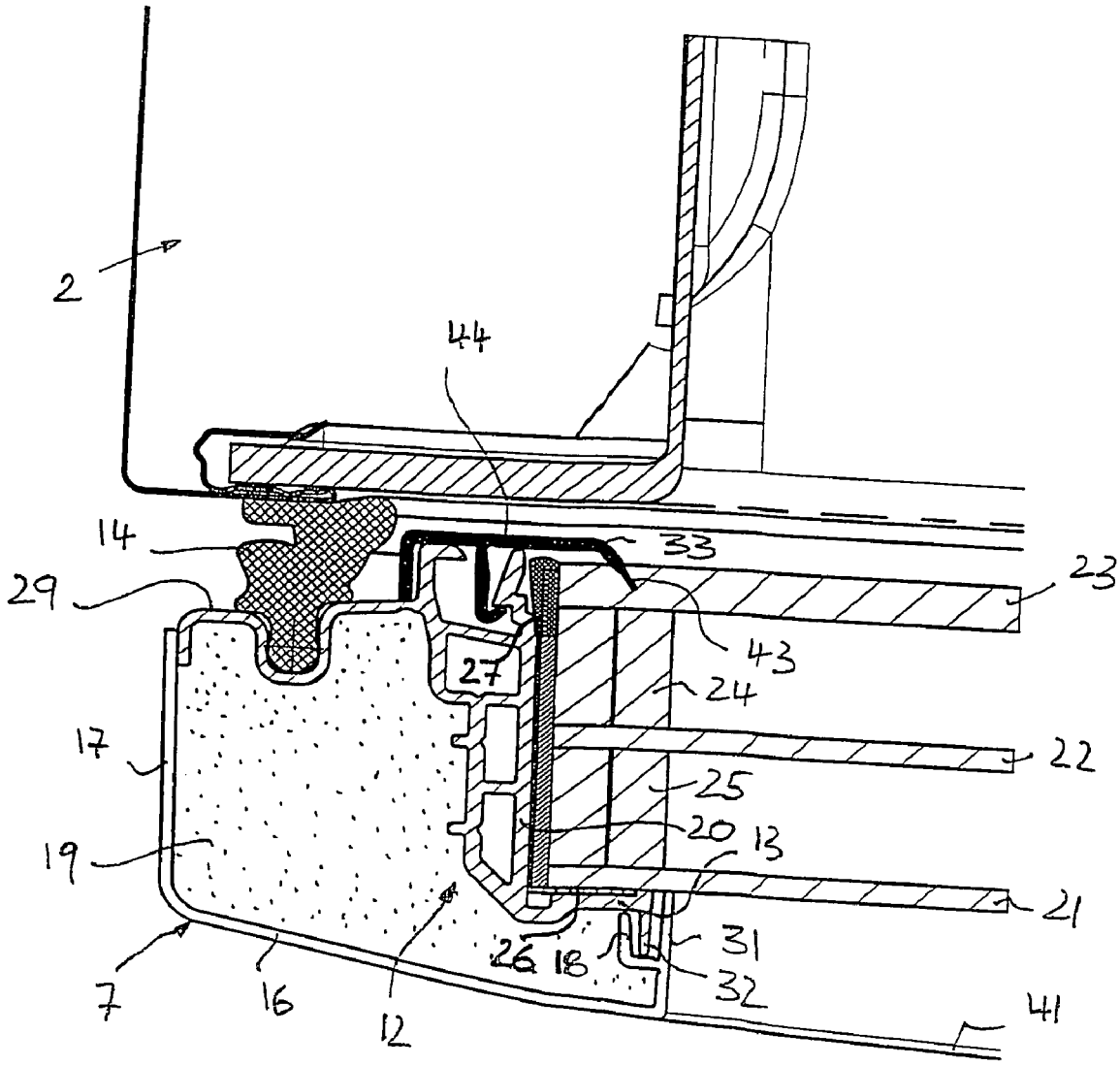
FIG. 3: a sectional view of the glass door of FIG. 1 in accordance with a preferred embodiment of the invention in which the plastic jacket is foam filled.

As FIG. 3 shows, the plastic jacket 7 has been injected into the desired cross-sectional contour such that the plastic jacket 7 includes a front-side section 16, a narrow-size section 17 as well as the rim web 31 encompassing the glazing pane portion. The rear side hollow space bounded in this manner by the plastic jacket 7 is foam filled so that a peripheral foam body 19 nestles over its full area on the rear-side wall of the plastic jacket 7 and forms a closed frame stiffening portion which considerably improves the dimensional accuracy of the plastic jacket. It is understood that an improved thermal insulation is also achieved by the under-foaming of the plastic jacket 7. The door frame 5 has a substantially improved K value.

Figure 4:
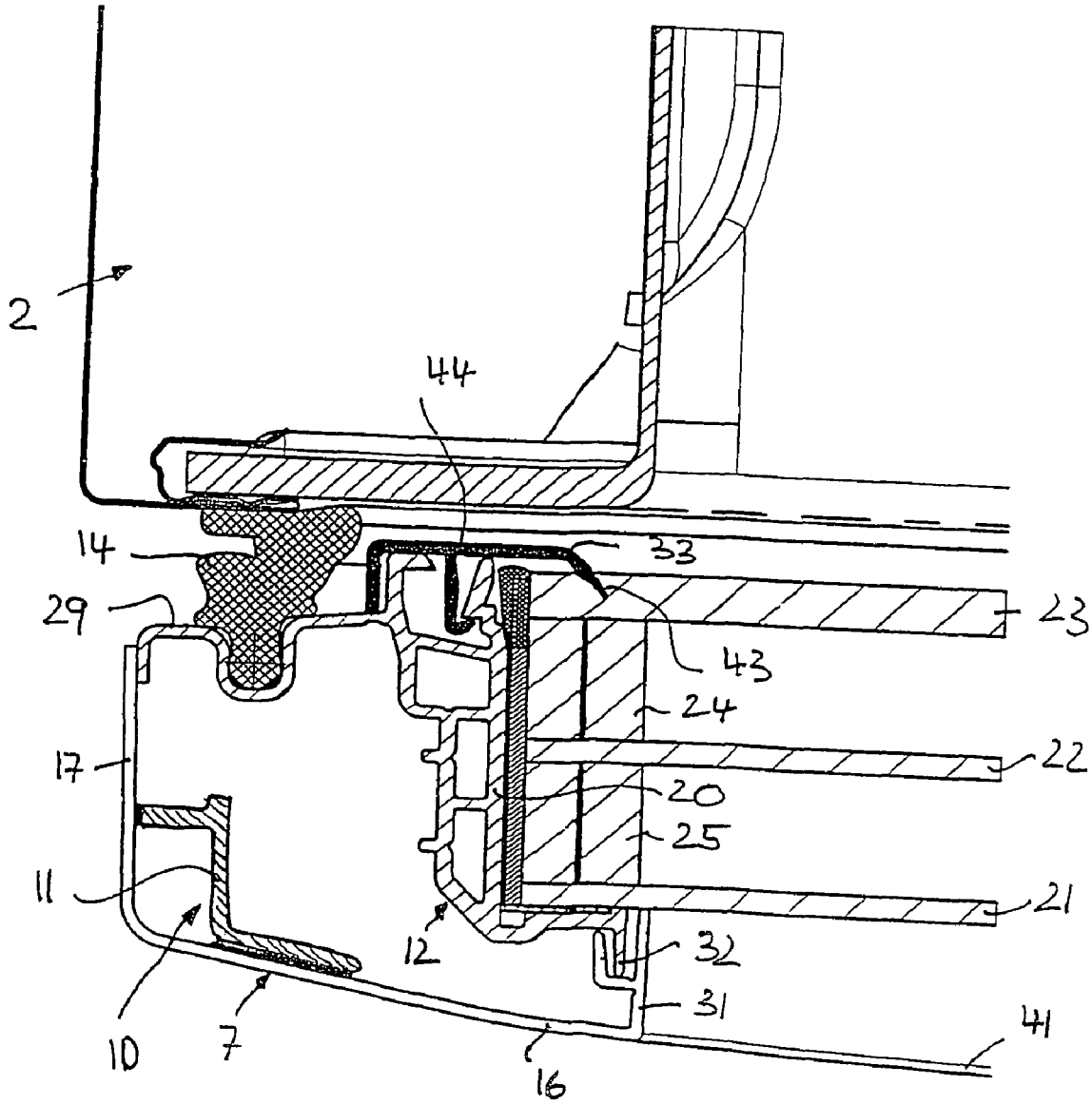
FIG. 4: a sectional view of the glass door of FIG. 1 in accordance with a further preferred embodiment of the invention in which the plastic jacket is provided with a frame stiffening portion of extruded sectional pieces.

To give the door the required stability and stiffness, a frame stiffening portion 10 can also be inserted at the rear side into the plastic jacket 7, as FIG. 4 shows, in the form of sectional pieces 11 which are connected to one another by adhesive bonding to obtain a closed stiffening frame which stabilizes the door, but which can optionally also be latched or clamped to one another. The stiffening sectional pieces 11 can be extruded sections or injection molded sections which are used along the lateral limbs or along the transverse limbs of the door frame 5. The frame stiffening portion 10 can also be shaped integrally to the plastic frame in the form of stiffening ribs which then project from the inner side of the plastic frame similar to the sectional pieces drawn in FIG. 4.

As FIG. 3 shows, a glazing pane holder 12 is foamed into the foam body 19 and has, on the one hand, the inwardly projecting support limbs 13 for the glazing pane 6 and a termination limb 20 angled in L shape with respect thereto. The section serving as the glazing pane holder 12 bounds the foam body 19 toward the open side of the door frame 5 not bounded by the plastic jacket 7. As FIGS. 3 and 4 show, a connector limb 29 of the glazing pane holder arranged at the rear is connected to the limb 17 of the plastic jacket forming the narrow side of the door, on the one hand. The door seal 14, which seals the door 3 with respect to the support carcass 2, is secured to the connector limb or support section 29.

The glazing 6 comprises a three-fold glazing comprising three glass panes 21, 22, 23 which are arranged parallel to one another and are connected to one another by spacers 24 and 25. The spacers 24 and 25 advantageously extend all around so that an insulation glazing packet results which is closed overall. The glazing pane 6 is inserted into the glazing pane holder 12 and can be fastened to the support limb 13 there by an adhesive bond 26. The glazing pane 6 is sealed by a peripheral seal 27 with respect to the bounding limb 20.

The support limb 13 on which the glazing pane 6 lies extends at the front-side end of the termination limb 20 of the glazing pane holder 12. A connection configured so-to-say as a labyrinth seal is provided between the support limb 13 and the plastic jacket 7. The rim 31 of the plastic jacket 7 adjacent to the central glazing pane opening extends toward the glazing pane 6, with it being formed in fork-shape as a sectional piece 18 toward the glazing pane 6. A rim web 32 of the glazing pane holder 12 shaped on the support limb 13 extends within the fork section.

In particular the front-side curvature of the plastic jacket visible from FIG. 2 toward the glazing pane is also compensated by the rim web 31 of said plastic jacket. The spacing of the glazing pane plane from the plastic jacket varies due to the curvature of the front side of said plastic jacket. The rim web 31 which is shaped on has a depth which varies over the length of the transverse limbs 11, i.e. its rear side facing the glazing pane forms a planar surface, whereby a gap between the glazing pane and the corresponding limb of the sectional piece 31 is minimized. A sharp, precise visual appearance can be achieved by the integrally shaped on rim web 31. A sharp-edged, angular formation of the glazing pane portion 41 can in particular be achieved by the kinking of the rim 31 at an acute angle.

The tolerance compensation for the glazing pane 6 is transposed so-to-say to the rear, i.e. to the inner side of the door, in the embodiment in accordance with FIGS. 3 and 4. Not only production tolerances are important here. It is rather the case that the multi-pane glazing can change its thickness due to pressure variations, for example on transport to higher elevations, so that a tolerance compensation is necessary. The glazing pane 6 is held in the glazing pane holder 12 by a peripheral seal 33. As FIG. 3 and FIG. 4 show, the seal 33 is latchable into the glazing pane holder 12 and covers the rim of the glazing pane 6. The peripheral seal 33 is advantageously injection molded or co-extruded from different plastics in the two-component process. The seal 33 can in particular have an elastic sealing lip 43 which is shaped onto a stiffer fastening portion 44. The stiffer fastening portion 44 is provided in the embodiment drawn with a latch arm with whose help the seal 33 is latchable to the glazing pane holder 12. The tolerance compensation required for the glazing pane is ensured by the elastic sealing lip 43. If the thickness of the glazing pane expands on pressure reductions, the sealing lip 43 yields accordingly.

The glazing holder 12 with the glazing pane 6 inserted therein is inserted into the open side of the plastic jacket 7 from the rear side. The hollow space being formed at the rear in the plastic jacket 7 is then foam-filled so that the glazing pane holder 12 is foamed into the foam body 19.

Figure 5:
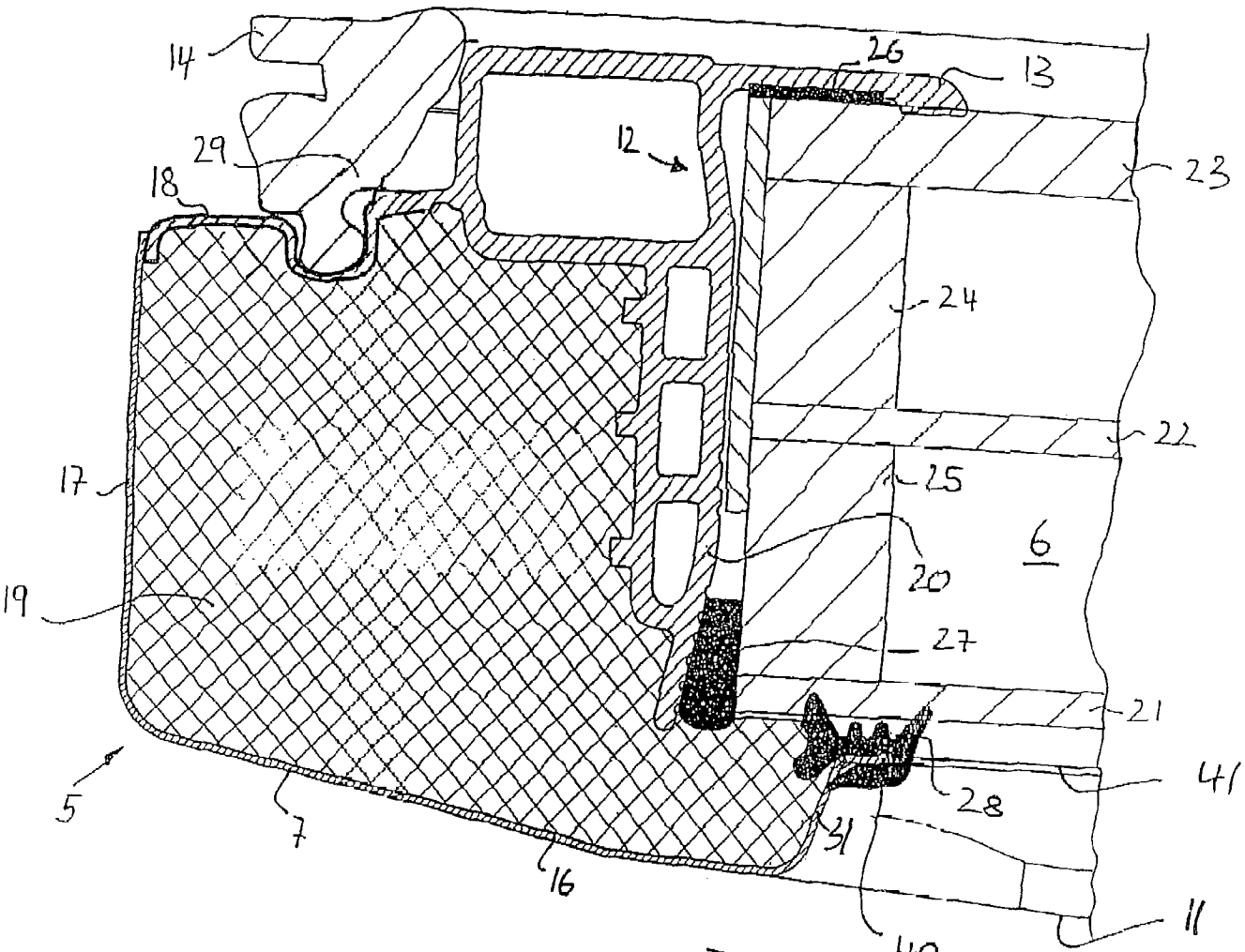
FIG. 5: a sectional view of a glass door similar to FIG. 3 in accordance with a further preferred embodiment of the invention in which the plastic jacket is foam filled.

The embodiment in accordance with FIG. 5 likewise includes the plastic jacket 7 which is bulbous over the door width, which is bent with three-limbs in cross-section and in whose central stamped-out portion the glazing pane 6 is inserted with the glazing pane holder 12 fastened thereto. The glazing pane holder 12 is also seated on the narrow-side limb section 17 of the plastic jacket 7 with a support section 29 here. The glazing pane holder 12 is, however, so-to-say oppositely configured. The support limb 13, on which the glazing pane 6 lies, does not extend at the front-side end, but at the rearward end of the termination limb 20 of the glazing pane holder 12. The tolerance compensation for the glazing pane 6 is transposed so-to-say to the front, i.e. to the unit outer side of the door, in the embodiment in accordance with FIGS. 3 and 4.

The glazing holder 12 with the glazing pane 6 inserted therein is inserted into the open side of the plastic jacket 7 from the rear side, with the rim of the central stamped-out portion of the plastic jacket 7 for the glazing pane 6 being sealed and cleanly terminated by a further seal 28 which is seated on the rim of the plastic jacket 7. The plastic jacket 7 is also foam-filled at the rear wall side in the embodiment of FIG. 5. The glazing pane holder 12 is foamed into the foam body 19 being formed.

As FIG. 5 shows, the rim 31 of the plastic jacket 7, which bounds the glazing pane section 41 of the plastic jacket, is angled inwardly while forming a rounded portion with respect to the front side of the plastic jacket 7, with the last rim web in turn being angled substantially parallel to the glazing pane plane. The plastic jacket 7 is given a considerably increased stiffness by the angled formation of the rim section 31. The seal 28 is seated on the rim web 40. It can be placed thereon running all round, with the sealing lips of the seal 28 being supported on the front side of the glazing pane and permitting a tolerance compensation. In this embodiment of the glass door, the glazing pane portion 41 is advantageously not made exactly angular, but rounded.

A homogeneous and quality visual impression is achieved by the throughgoing plastic jacket 7 which now comprises a material dyed the same and aligned over the full area. Color deviations, visible gap formation or abutment positions are hereby precluded. In addition, the option exists of printing, lacquering or thermal sublimation, whereby the visible surface of the door frame can be adapted to customized desires. A color matching of the glass door to the unit carcass 2 is naturally also possible, which was previously only possible with restrictions due to different materials.

The invention claimed is:

1. A refrigerator unit and/or a freezer unit comprising a glass door (3) in turn having a door frame (5), and a glazed pane (6) inserted into the door frame (5), wherein the door frame (5) comprises a plastic jacket (7) integrally shaped in one piece around its entire periphery forming a front/exterior side of the door frame (5) and including limb sections (16, 17) covering at least the front/exterior side and narrow sides of the door frame (5), and a peripheral glazing pane holder (12) connected to said plastic jacket (7), the plastic jacket (7) forms an outer envelope integrally extending along bottom, top and sides of the door (3) free of seams on the front visible side of the door (3), and additionally comprising a peripheral foam body (19) into which the glazing pane holder (12) is foamed and with which the plastic jacket (7) is peripherally foamed under or foamed-out or foam-filled on a rear side of the jacket (7) whereby the jacket is filled such that the peripheral foam body (19) nestles over the entire rear side of the plastic jacket (7) and forms a closed frame stiffening portion improving dimensional accuracy of the plastic jacket (7).

2. A refrigerator unit and/or a freezer unit in accordance with claim 1, wherein the plastic jacket (7) comprises an injection molded plastic section.

3. A refrigerator unit and/or a freezer unit in accordance with claim 2, wherein a frame stiffener (10) is peripherally inserted into the plastic jacket (7) and has a plurality of sectional pieces (11), in particular extruded sections, which are connected to the plastic jacket (7) at the rear thereof.

4. A refrigerator unit and/or a freezer unit in accordance with claim 3, wherein the sectional pieces (11) are connected to one another, in particular adhesively bonded to one another, and are assembled to form a rigid peripheral stiffening frame.

5. A refrigerator unit and/or a freezer unit in accordance with claim 1, wherein the plastic jacket (7) has a surface coating, is preferably lacquered, at least at the front side.

6. A refrigerator unit and/or a freezer unit in accordance with claim 1, wherein a frame stiffener (10) is peripherally inserted into the plastic jacket (7).

7. A refrigerator unit and/or a freezer unit in accordance claim 6, wherein the frame stiffener (10) is included in the foam body (19).

8. A refrigerator unit and/or a freezer unit in accordance with claim 6, wherein the glazing pane holder (12) is fastened to the frame stiffener (10), is preferably made integrally therewith.

9. A refrigerator unit and/or a freezer unit in accordance with claim 1, wherein the plastic jacket (7) has a bulbously formed front side over the width and/or the height of the door (3).

10. A refrigerator unit and/or a freezer unit in accordance with claim 9, wherein the front side of an upper and/or lower transverse limb (11) of the plastic jacket (7) has a curvature in the longitudinal direction of said upper and/or lower transverse limb (11).

11. A refrigerator unit and/or a freezer unit in accordance with claim 1, wherein the plastic jacket (7) has a glazing pane section (41) which preferably rises gap-free on the glazing pane.

12. A refrigerator unit and/or a freezer unit in accordance with claim 1, wherein the plastic jacket (7) has an angled glazing pane portion (41) in which a rim of the plastic jacket (7) bounding the glazing portion with respect to an adjacent front-side limb of the plastic jacket (7) preferably kinks at a right angle or an acute angle.

13. A refrigerator unit and/or a freezer unit in accordance with claim 12, wherein the glazing pane holder (12) is connected to the plastic jacket (7) in shape-matched manner at the glazing pane portion of the door frame, is preferably placed in a groove formed by the plastic jacket.

14. A refrigerator unit and/or a freezer unit in accordance with claim 1, wherein the glazing pane holder (12) has a support limb (13) which projects inwardly from the door frame (5) and on which the flat side of the glazing pane (6) lies, is preferably firmly adhered.

15. A refrigerator unit and/or a freezer unit in accordance with claim 1, wherein the glazing pane (6) is a multi-glazing in which a plurality of glass panes (21, 22, 23) are arranged spaced apart from one another, are preferably connected to one another by spacers (24, 25).

16. A refrigerator unit and/or a freezer unit in accordance with claim 1, wherein a seal (27, 28), in particular an elastic lip seal, is provided between the plastic jacket (7) and the glazing pane (6) and/or between the glazing pane holder (12) and the glazing pane (6).

17. A refrigerator unit and/or a freezer unit in accordance with claim 1, wherein the glazing pane (6) is supported by means of an elastic seal (33) which engages around the glazing pane (6) and permits a tolerance compensation for the glazing pane.

18. A refrigerator unit and/or a freezer unit in accordance with claim 17, wherein the seal (33) has sections of different hardness and/or flexibility, in particular a soft sealing lip which is shaped on a harder fastening section.

19. A refrigerator unit and/or a freezer unit in accordance with claim 18, wherein the seal (33) is injected molded or co-extruded from different materials in a two-component process.

20. A refrigerator unit and/or a freezer unit in accordance with claim 1, wherein an elastic seal (33) is arranged on the inner door side of the glazing pane (6).

21. A refrigerator unit and/or a freezer unit in accordance with claim 1, wherein the plastic jacket (7) has a rim web (40) angled with respect to the front side of the plastic jacket (7) toward the glazing pane portion (41).

22. A refrigerator unit and/or a freezer unit in accordance with claim 21, wherein the elastic seal is seated on the rim web (40).

23. A refrigerator unit and/or a freezer unit in accordance with claim 1, wherein an additional application, in particular a heating, a lighting device (15), a thermometer (8), is provided at the door frame (5) between the plastic jacket (7) and the glazing pane (6).

24. A refrigerator unit and/or a freezer unit in accordance with claim 1, wherein a lighting device (15) to illuminate the glazing pane (6) is provided at the door frame (5).

* * * * *